US010617211B1

(12) United States Patent
Lee

(10) Patent No.: US 10,617,211 B1
(45) Date of Patent: Apr. 14, 2020

(54) POCHADE BOX WITH SLIDING PARALLEL PALETTE

(71) Applicant: Mykul S Lee, Pacific Palisades, CA (US)

(72) Inventor: Mykul S Lee, Pacific Palisades, CA (US)

( * ) Notice: Subject to any disclaimer, the term of this patent is extended or adjusted under 35 U.S.C. 154(b) by 0 days.

(21) Appl. No.: 16/520,362

(22) Filed: Jul. 24, 2019

Related U.S. Application Data

(60) Provisional application No. 62/703,016, filed on Jul. 25, 2018.

(51) Int. Cl.
*A47B 97/08* (2006.01)

(52) U.S. Cl.
CPC ..... *A47B 97/08* (2013.01)

(58) Field of Classification Search
CPC ..... A47B 97/08; A47B 97/02; A47B 97/04
See application file for complete search history.

(56) References Cited

U.S. PATENT DOCUMENTS 4,093,326 A * 6/1978 Ford ..... A47B 97/08 248/461
4,372,630 A * 2/1983 Fuhri ..... A47B 97/08 206/1.7
5,088,802 A * 2/1992 House ..... A47B 97/04 108/6
5,833,201 A * 11/1998 Graybill ..... A47B 97/08 248/462
6,745,988 B2 * 6/2004 Gelfand ..... A47B 97/04 248/460
7,118,084 B2 * 10/2006 Park ..... A47B 97/08 248/460
2001/0048059 A1 * 12/2001 Jones, II ..... A47B 97/08 248/461
2004/0031900 A1 * 2/2004 Chang ..... A47B 97/08 248/461
2007/0170340 A1 * 7/2007 Almond ..... A47B 97/08 248/454
2008/0191113 A1 * 8/2008 Edgmon ..... A47B 97/08 248/451
2015/0034501 A1 * 2/2015 Duffy ..... B44D 3/04 206/1.7
2015/0321505 A1 * 11/2015 Carter ..... B65D 81/18 206/1.7
2016/0075173 A1 * 3/2016 Hutton ..... B44D 3/02 206/1.7
2018/0264876 A1 * 9/2018 Davis ..... B44D 3/04

* cited by examiner

*Primary Examiner* — Daniel J Rohrhoff
(74) *Attorney, Agent, or Firm* — Plager Schack LLP; Mark H. Plager; Kara Verryt

(57) ABSTRACT

A pochade box for artists may include a sliding parallel palette. Specifically, the pochade box may include a box having a lid hingeably attached to a box body; a workpiece securing member slidably attached to the lid such that the workpiece securing member slides out of an edge of the lid distal from the box body when the lid is open, the workpiece securing member designed to hold a workpiece; and a palette slidably engaged with the lid such that the palette slides horizontally side to side when the lid is open, resulting in the palette being oriented parallel with the workpiece.

5 Claims, 3 Drawing Sheets

POCHADE BOX WITH SLIDING PARALLEL PALETTE

RELATED APPLICATION

This application claims priority to provisional patent application U.S. Ser. No. 62/703,016 filed on Jul. 25, 2018, the entire contents of which is herein incorporated by reference.

BACKGROUND

The embodiments described herein relate generally to artist's tools, and more particularly, to a pochade box with a sliding parallel palette.

Artist's use pochade boxes out in the field to have a tool for holding their canvas and tools, such as paints and paint brushes. Conventional pochade boxes include a palette that can be extended perpendicularly to the painting surface, usually resting atop the bottom compartment of the box. Having a parallel palette can be extremely beneficial for an artist, because it allows the artist to view the colors adjacent to the canvas and work of art.

Therefore, what is needed is a pochade box with a parallel palette slidably attached thereto.

SUMMARY

Some embodiments of the present disclosure include a pochade box for artists with a sliding parallel palette. Specifically, the pochade box may include a box having a lid hingeably attached to a box body; a workpiece securing member slidably attached to the lid such that the workpiece securing member slides out of an edge of the lid distal from the box body when the lid is open, the workpiece securing member designed to hold a workpiece; and a palette slidably engaged with the lid such that the palette slides horizontally side to side when the lid is open, resulting in the palette being oriented parallel with the workpiece.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

Figure 1:
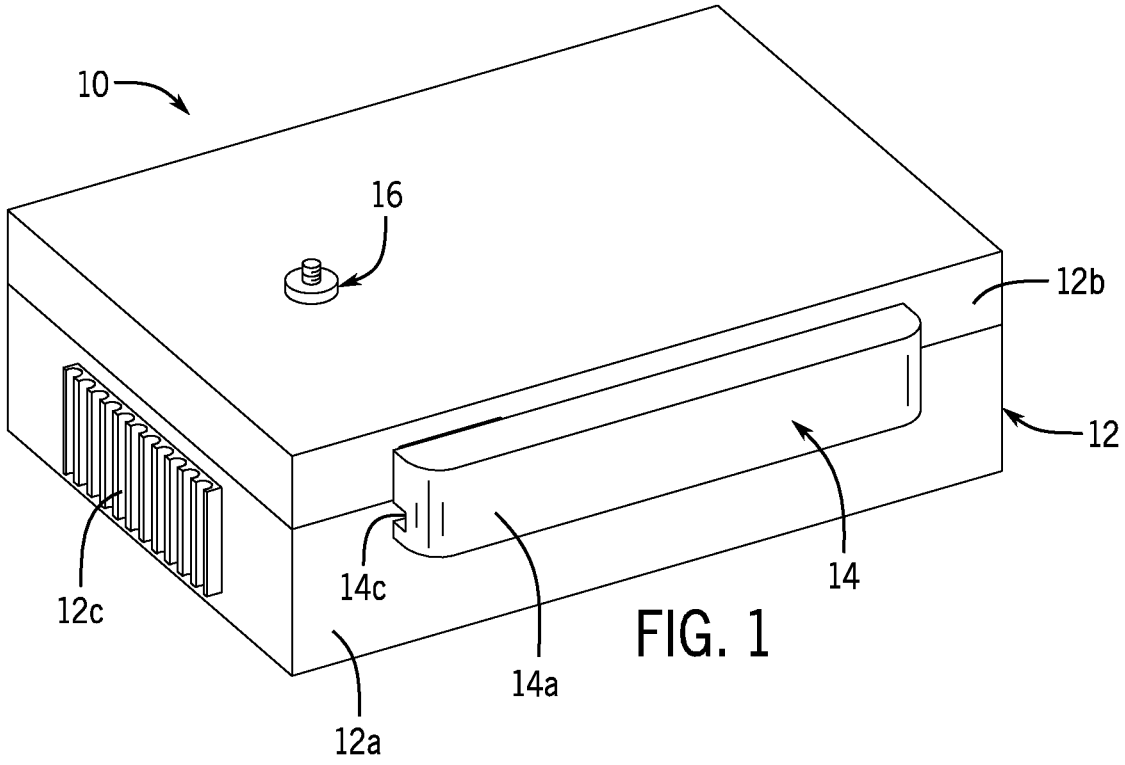
FIG. 1 is a top perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as an artist's pochade box and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

a. Box
b. Securing Member
c. Sliding Parallel Palette

The various elements of the device of the present invention may be related in the following exemplary fashion. It is not intended to limit the scope or nature of the relationships between the various elements and the following examples are presented as illustrative examples only.

By way of example, and referring to FIGS. 1-5, some embodiments of the invention include a pochade box 10 for artists, the pochade box 10 comprising a box 12 having a lid 12*d* hingeably attached to a box body 12*a*, a workpiece securing member 14 slidably attached to the lid 12*b* such that the workpiece securing member 14 slides out of an edge of the lid 12*b* distal from the box body 12*a* when the lid 12*b* is open, the workpiece securing member 14 designed to hold a workpiece 15, such as a canvas; and a palette 18 slidably engaged with the lid 12*b* such that the palette 18 slides horizontally side to side when the lid 12*b* is open, resulting in the palette 18 being oriented parallel with the workpiece 15. As such, the pochade box 10 of the present disclosure comprises a pochade box with a sliding parallel palette 18. While the Figures show the palette sliding out of the right hand side of the lid 12*b*, the pochade box 10 may be designed such that the palette 18 can slide out of the left hand side instead. Alternatively, some versions of the pochade box 10 may include a palette 18 that can slide out of either the left or the right hand side.

As mentioned above, the box 12 may comprise a lid 12*b* hingeably attached to a body 12*a*. In some embodiments, the lid 12*b* may be attached to the body 12*a* by a friction hinge 12*d*. However the use of other types of hinges are envisioned. The box body 12*a* may comprise walls attached to a floor defining an interior region of the box body 12*a*, which may be divided into multiple sections by use of at least one divider 12*e*. A body latch 24*b* designed to engage with a lid catch 24*a* on the lid 12*b* may be positioned on an outer surface of a wall of the box body 12*a*. For example, the body latch 24*b* may be positioned on the wall furthest from the lid 12*b* when the box 12 is open. The box body 12*a* may also have various accessories attached thereto. For example, the box body 12*a* may have a brush holder, such as a clip-in brush holder 12*c* attached to an outer surface thereof, thus giving the artist an easy place to store brushes while painting. While not shown in the Figures, some embodiments of the box 10 also include a wet panel holder for storing a painting before it has dried.

Figure 2:
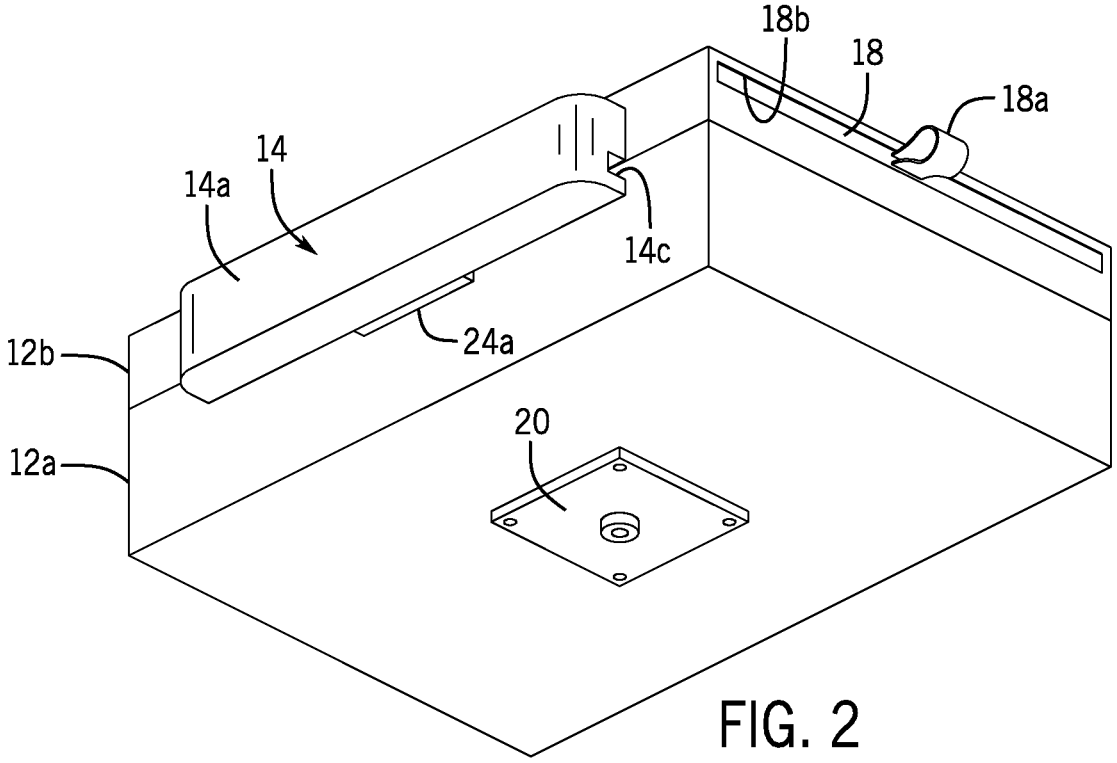
FIG. 2 is a bottom perspective view of one embodiment of the present disclosure.
Figure 3:
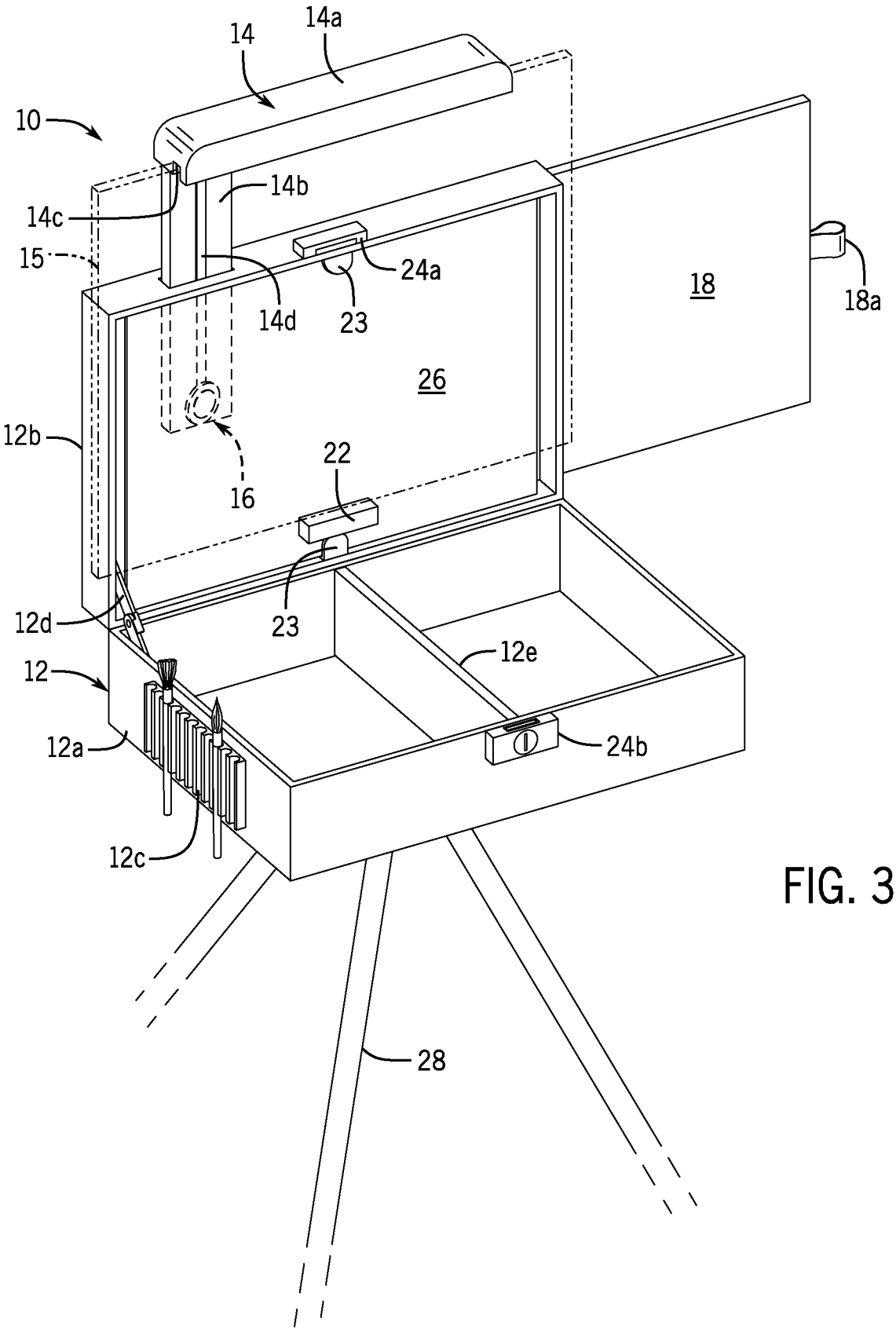
FIG. 3 is a front perspective view of one embodiment of the present disclosure.
Figure 5:
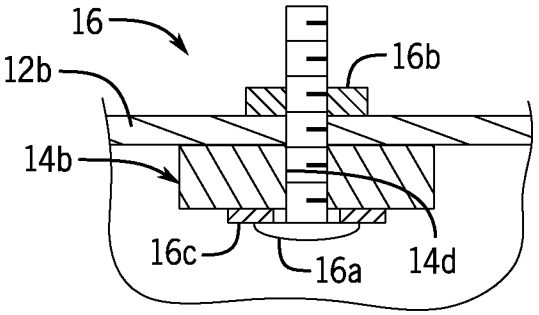
FIG. 5 is a detail cross-sectional view of one embodiment of the present disclosure, taken along line 5-5 in FIG. 4.
Figure 4:
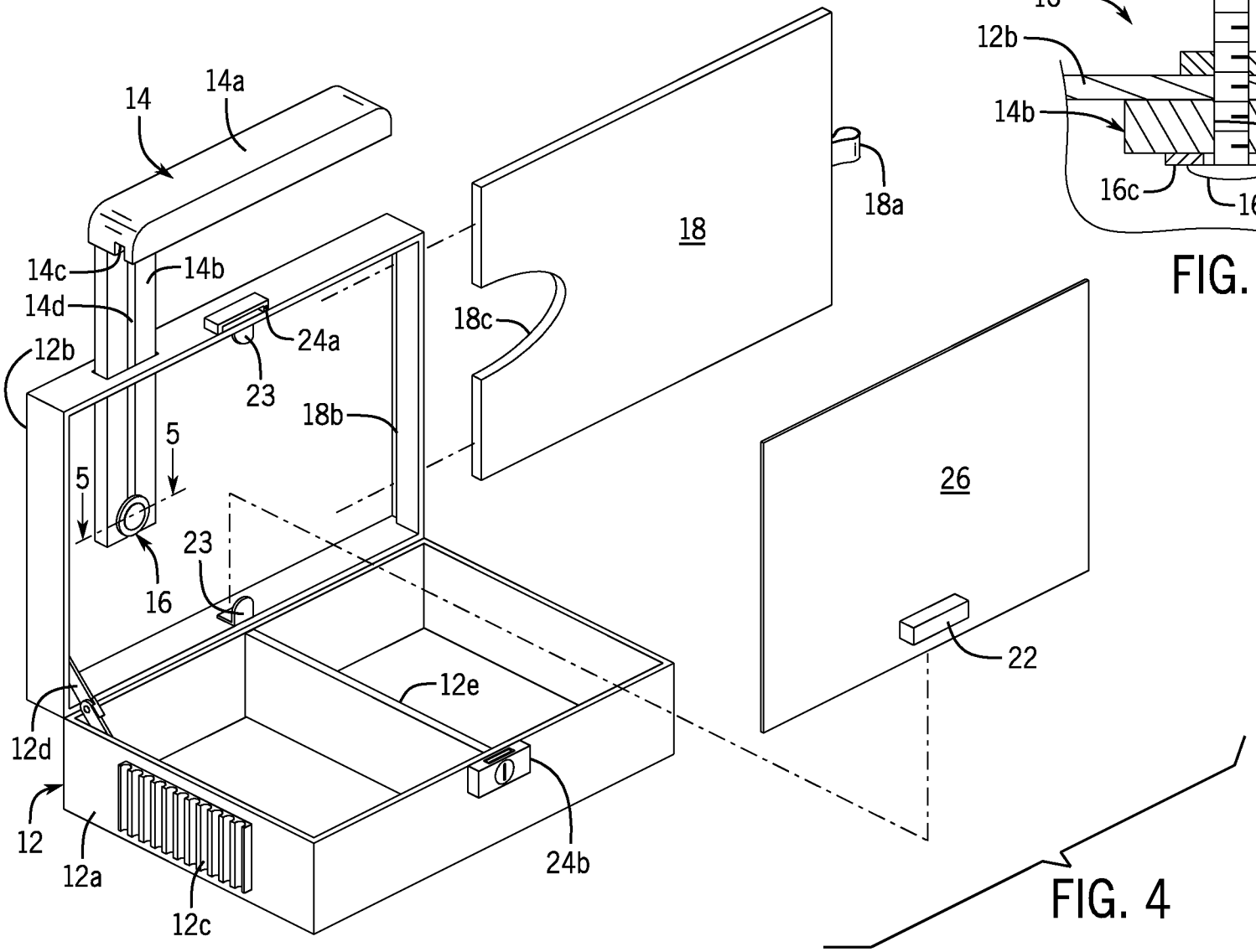
FIG. 4 is an exploded perspective view of one embodiment of the present disclosure.

Similar to the box body 12*a*, the lid 12*b* may comprise walls extending from a top surface defining an interior of the lid 12*b*. The lid 12*b* walls and the body 12*a* walls may be positioned to align when the box 12 is closed, as shown in FIGS. 1 and 2. The inner surface of two parallel walls of the lid 12*b* may have L-brackets 23 attached thereto. The L-brackets 23 may be used to removably secure an inner lid 26 to the lid 12*b*. The inner lid 26 may function to close off the interior region of the lid 12*b*. Moreover, the inner lid 26 may include a resting block 22 extending therefrom, the resting block 22 designed to support a bottom surface of the workpiece 15. The lid 12*b* may also include the securing member 14 slidably attached thereto, wherein the securing member 14 may comprise a cross arm 14*a* perpendicularly attached to a sliding member 14*b*. The sliding member 14*b* may be designed to slide vertically through a slot in a wall of the lid 12*b* when the box 12 is in an open configuration. The height of the cross arm 14*a* may be set by using a locking clamp 16 to secure the sliding member 14*b* in the desired position. Specifically, as shown in FIGS. 4 and 5, the sliding member 14*b* may include a slot 14*d* extending therethrough along at least a portion of the length thereof. The locking clamp 16 may include a bolt 16*a* designed to extend through the sliding member 14*b* and the lid 12*b* and engage with a nut 16*b* on an exterior of the lid 12*b*. A washer 16*c* may be positioned between the bolt 16*a* and the sliding member 14*b*. To adjust the height of the cross arm 14*a*, the nut 12*b* may be loosened, the sliding member 14*b* may be slid to its desired position, and the nut 16*b* may be retightened. The cross arm 14*a* may include a groove 14*c* into a bottom surface thereof. Thus, a workpiece 15 may be placed on the resting block 22 and the securing member 14 may be lowered until a top of the workpiece 15 is engaged with the cross arm 14*a*, securing the workpiece 15 in place.

The lid 12*b* may also include a slot 18*b* in at least one of the side walls thereof, such that a palette 18 may slide in and out of the slot 18*b* to provide a parallel palette for the artist. In some embodiments, the sliding palette 18 may have a pull loop 18*a* on a first side thereof, wherein the pull loop 18*a* may assist a user in sliding the palette out of the lid, and a clearance opening 18*c* on a second side thereof, wherein the clearance opening 18*c* may be designed to provide clearance for the locking clamp 16 when the palette 18 is slid all the way into the lid 12*b*. Moreover the clearance opening 18*c* may be designed to fit underneath and be locked into place by the securing member 14 during transport. In some embodiments, the lid 12*b* may also include rails attached to inner surfaces of the walls to help keep the palette 18 in the correct position at all times.

At times, a user may wish to place the pochade box 10 on a tripod during use. Thus, in some embodiments, a bottom surface of the box body 12*a* may have a tripod-receiving bracket 20 attached thereto, wherein the tripod-receiving bracket 20 is designed to removably engage with a tripod 28.

To use the pochade box 10 of the present disclosure, a user may open the lid 12*b*, slide the securing member 14 up and away from the box body 12*a*, place a workpiece 15 on the resting block 22, slide the securing member 14 back down to secure the workpiece 15 to the lid 12*b*, and slide the palette 18 out of the side of the lid 12*b*, such that the user has a workpiece 15 and palette 18 that are parallel to one another.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claim.

What is claimed is:

1. A pochade box for artists, the pochade box comprising:

a box having a lid hingeably attached to a box body, the box configured to support workpiece;

a palette slidably engaged with the lid such that the palette slides horizontally side to side when the lid is open, resulting in the palette being oriented parallel with the workpiece; and a workpiece securing member slidably attached to the lid such that the workpiece securing member slides out of an edge of the lid distal from the box body when the lid is open, the workpiece securing member designed to hold the workpiece, wherein:

the lid comprises walls extending from a top surface defining an interior region of the lid;

an inner lid removably secured to the lid, wherein the inner lid is designed close off the interior region of the lid;

the inner lid has a resting block extending therefrom, the resting block designed to support a bottom surface of the workpiece;

a wall of the lid distal from the box body when the lid is open comprises the securing member slidably attached thereto;

the securing member comprises a cross arm perpendicularly attached to a sliding member; and the sliding member slides vertically through a slot in the wall of the lid distal from the box body.

2. The pochade box of claim 1, wherein:

the lid further comprises a slot in at least one side walls thereof; and the slot is sized to accommodate passage of the palette therethrough, wherein the palette is a parallel palette extending from a side of the lid.

3. The pochade box of claim 2, wherein:

the securing member includes a locking clamp attached thereto; and the palette comprises a clearance opening on an edge thereof, the clearance opening designed to provide clearance for the locking clamp when the palette is slid all the way into the lid.

4. The pochade box of claim 1, wherein the palette comprises a pull loop attached to a first side thereof.

5. The pochade box of claim 1, wherein the lid further comprises rails attached to an inner surface thereof, the rails being designed to support the palette and keep the palette aligned in parallel with the lid.

* * * * *